United States Patent [19]

Chase

[11] 4,044,643

[45] Aug. 30, 1977

[54] MUSICAL INSTRUMENT CIRCUIT PROVIDING CELESTE AND VIBRATO EFFECTS

[76] Inventor: Willis E. Chase, P.O. Box 4042, Lancaster, Pa. 93534

[21] Appl. No.: 570,650

[22] Filed: Apr. 23, 1975

Related U.S. Application Data

[63] Continuation-in-part of Ser. No. 431,937, Jan. 9, 1974, abandoned.

[51] Int. Cl.[2] ..... G10H 1/02; G10H 5/02

[52] U.S. Cl. ..... 84/1.24; 84/1.25; 84/DIG. 4; 84/DIG. 8

[58] Field of Search ..... 84/1.01, 1.13, 1.24–1.26, 84/DIG. 4, DIG. 5, DIG. 8

[56] References Cited

U.S. PATENT DOCUMENTS

| | | | |
|---|---|---|---|
| 2,939,359 | 6/1960 | Markowitz | 84/DIG. 4 |
| 3,037,413 | 6/1962 | Markowitz | 84/1.24 |
| 3,288,904 | 11/1966 | George | 84/1.01 |
| 3,490,327 | 1/1970 | Volpe | 84/1.25 |
| 3,609,201 | 9/1971 | Adachi | 84/.01 |
| 3,609,203 | 9/1971 | Adachi | 84/1.01 |
| 3,639,853 | 2/1972 | Sakai | 84/1.01 X |
| 3,659,031 | 4/1972 | Adachi | 84/1.01 |
| 3,701,040 | 10/1972 | Borrevik et al. | 84/1.25 X |
| 3,715,445 | 2/1973 | Kniepkamp | 84/1.13 |
| Re. 27,983 | 4/1974 | Stearns | 84/1.01 |

*Primary Examiner*—Stanley J. Witkowski

[57] ABSTRACT

A circuit is shown for changing the frequency of a basic keyed oscillator by controlling the amount of keying voltage reaching the oscillator and the circuit used for vibrato. The purpose of this circuit is the achievement of true "pipe organ celeste" effect without using an added rank or set of oscillators. Circuits are described wherein the harmonic structure of the signal resulting from this modification of a basic keyed oscillator can be made to change by means of controlling the amount of keying voltage reaching the oscillator for the purpose of achieving the desired harmonic structure of the rank when operated in the "non-celeste" mode as opposed to the "celeste" mode. A circuit is also described for amplitude modulation and harmonic structure modulation at the vibrato rate to enhance the vibrato.

9 Claims, 7 Drawing Figures

MUSICAL INSTRUMENT CIRCUIT PROVIDING CELESTE AND VIBRATO EFFECTS

This application is a continuation-in-part of application Ser. No. 431,937, filed Jan. 9, 1974, and now abandoned.

DESCRIPTION OF THE PRIOR ART

Many pipe organs employ one or more ranks of pipes which are purposely detuned from the balance of the organ to produce an effect called celeste. This effect is a warm, broad, and undulating sound having random beats generally of one to six beats per second (depending on what portion of the keyboard it is played) when this celeste rank is played in conjunction with a rank of pipes having similar tone quality and volume. In the electronic organ field, attempts to achieve this effect have been tried using slowly rotating speakers, slowly moving baffles in front of speakers, and/or slow phase modulation.

For many reasons, these attempts have fallen short of the desired effect but the obvious solution of providing a separate additional rank of electronic generators to provide this effect has been resisted by electronic organ manufacturers because of its relatively high added cost (as compared with a pipe organ) of adding so much circuitry for the achievement of this effect.

Novel and unique means are herein defined where this effect is achieved at very low added cost in an organ that has rank or a set of 61 notes, for example, of keyed oscillators of special design together with at least one other rank or set of tone generators. This rank of oscillators, when keyed at the normal voltage provides a unit stop of some useful character such as "principal" or "gemshorn" or "string" for example, but when keyed at the lower celeste voltage is detuned such that when combined with the other rank of tone generators at unison pitch, the desired celeste effect is produced.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which;

DESCRIPTION OF THE PREFERRED EMBODIMENT

Figure 1:
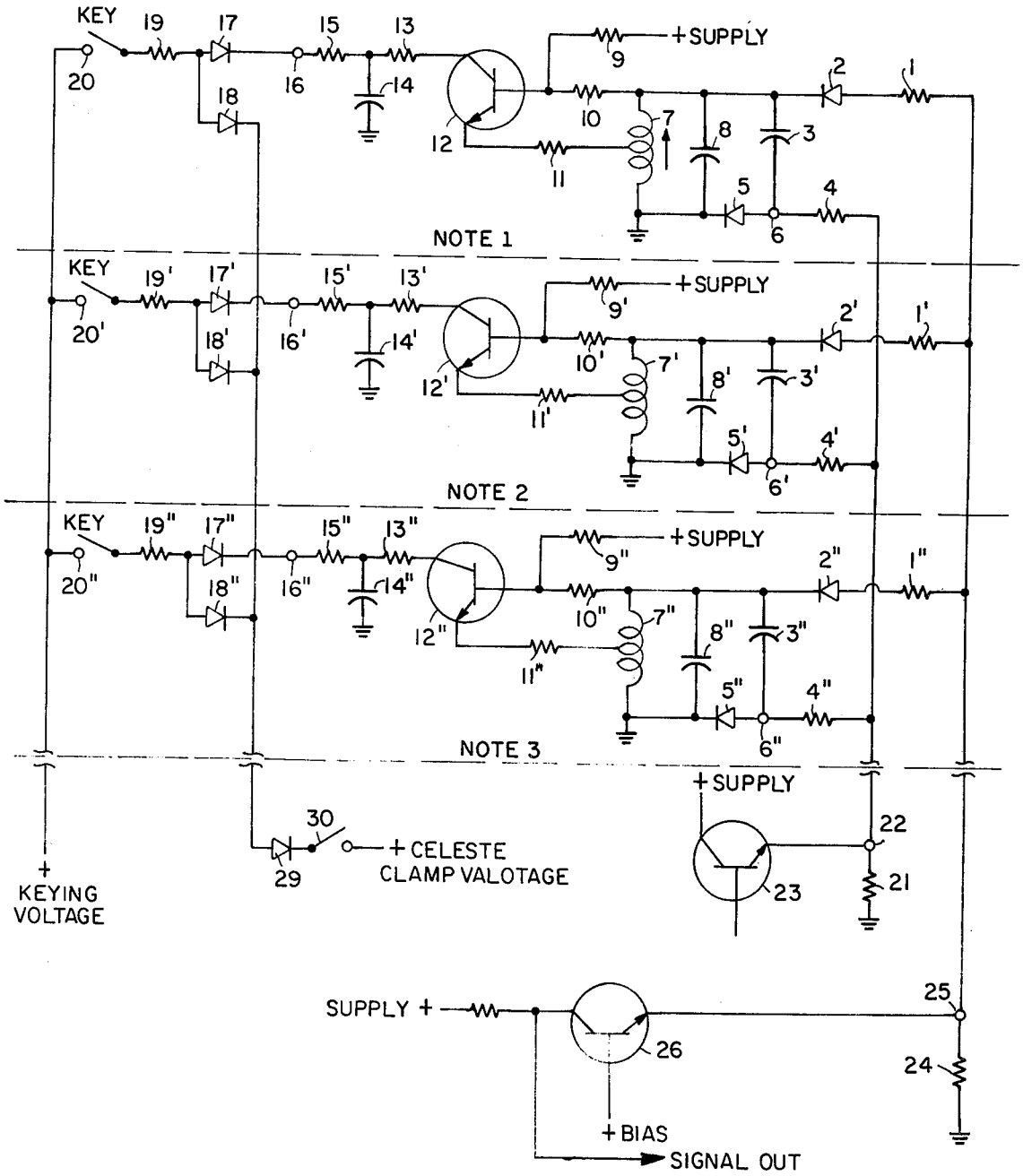
FIG. 1 is a circuit diagram showing one embodiment of the invention.

Referring to FIG. 1, an oscillator is shown consisting of transistor 12, tapped inductor 7, capacitor 8, and bias network for transistor 12 consisting of resistors 9 and 10. The base of transistor 12 is connected to one end of inductor 7 through resistor 10 and the emitter of transistor 12 is connected to the top of inductor 7 through resistor 11.

Keying voltage is applied to this oscillator through resistors 13 and 15 and capacitor 14 so that the attack and release may be controlled and may be adjusted to a pipe-like quality.

When the oscillator is keyed into operation by action of key switch 20, a sine wave appears across inductor 7 and capacitor 8. This sine wave supplies A.C. current to point 6 through capacitor 3. Point 6 is supplied with D.C. current through resistor 4 from the emitter of transistor 23. These two currents add in point 6 and as long as the sum is positive, diode 5 is in conduction, and point 6 is effectively connected to ground through diode 5. When the sum of these two currents is negative, diode 5 goes out of conduction and the voltage at point 6 goes below ground potential. The amplitude of this sine wave across inductor 7 is dependent on the amount of keying voltage actually reaching point 16 and several means are shown for controlling this voltage. The higher voltage across inductor 7 (normal keying voltage) causes diode 5 to go out of conduction for a larger portion of the cycle as compared with when the lower voltage appears across inductor 7 because this higher voltage causes increased current to flow through capacitor 3 into point 6, which in the negative portion of its cycle, cancels the D.C. current supplied by resistor 4 into this point for a larger portion of the cycle.

Capacitor 3, when connected across tuning capacitor 8 will cause the oscillator to operate at a lower frequency. When diode 5 is conducting capacitor 3 is connected across tuning capacitor 8. If diode 5 is in conduction 50% of the time, half value of capacitor 3 is added to capacitor 8. When the oscillator is operated with a high voltage at point 16, the signal voltage across inductor 7 is higher than when the oscillator is operated with a low voltage at point 16. This higher signal voltage causes diode 5 to be driven out of conduction for a larger percentage of time then when the lower signal voltage is present across inductor 7. Therefore, the frequency of operation will be higher with the higher keying voltage, and lower with the lower keying voltage.

Figure 5:
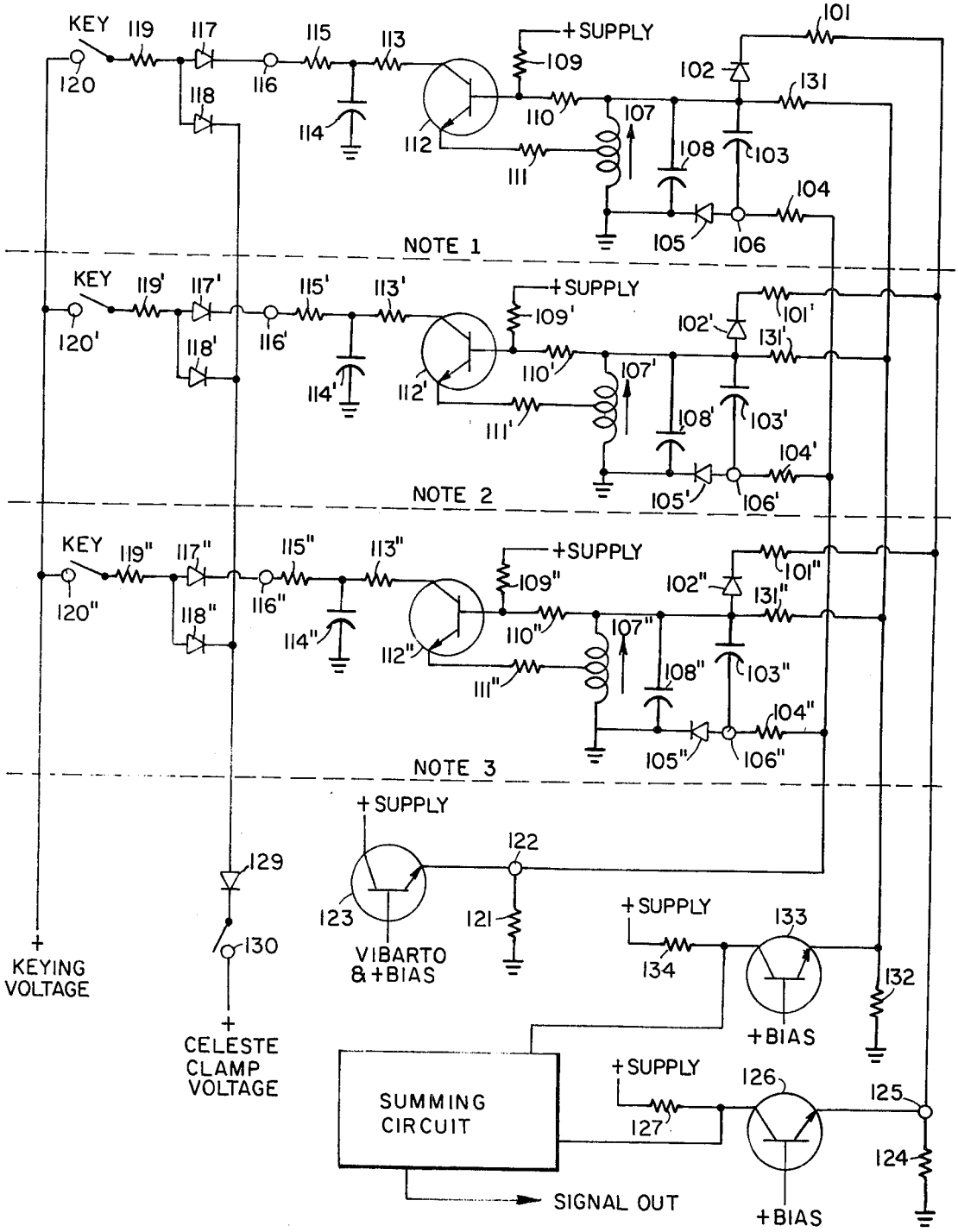
FIG. 5 is a circuit diagram showing an alternate embodiment of the invention.

In FIG. 1, vibrato voltage is applied to the base of transistor 23 and this causes the voltage at its emitter to be raised and lowered at the vibrato frequency. Point 6 is supplied with D.C. current through resistor 4 from the emitter of transistor 23, and this current is thus modulated at the vibrato frequency. This current adds with the A.C. current supplied to point 6 through capacitor 3 when the oscillator is in operation and causes diode 5 to be in conduction, or to go out of conduction as is described in the specification. Therefore, the percentage of time that diode 5 is in conduction is modulated at the vibrato rate and also the percentage of time capacitor 3 is connected across inductor 7 by diode 5 is so modulated. Since connecting capacitor 3 across inductor 7 lowers the frequency of oscillation, frequency modulation is achieved by independent means. In FIG. 5, the same illustration holds true with transistor 123 substituted for 23, point 106 substituted for 6, resistor 104 substituted for 4, diode 105 substituted for 5, capacitor 103 substituted for 3, and inductor 107 substituted for 7.

One method of controlling the voltage at point 16 is shown in FIG. 1. The + celeste clamp voltage is lower in magnitude than the + keying voltage and is obtained from a rigid or non-varying source. When switch 30 is closed, and key switch 20 is closed, the voltage at the junction of diodes 17 and 18 and resistor 19 is limited by the + Celeste Clamp Voltage because current is caused to flow through resistor 19, and diodes 18 and 29 in series causing the voltage drop across resistor 19 to be increased to make up the difference between the + keying voltage and the + celeste clamp voltage. When switch 30 is open, no extra current is caused to flow through resistor 19 when key switch 20 is closed, causing full voltage to appear at point 16.

In FIGS. 1 and 5 three notes of an embodiment of the invention are shown to illustrate their combination in a polyphonic electronic musical instrument. The foregoing discussion of the operation of inductor 7, for example, in the circuit of note 1, applies equally to the operation of inductor 7' of note 2, and inductor 7'' of note 3. In like manner, the other elements of these notes having related numbers operate. Their values are not exactly the same, however, since they are adjusted to produce the notes A, B, C, D, E, F, G and their sharps.

Figure 2:
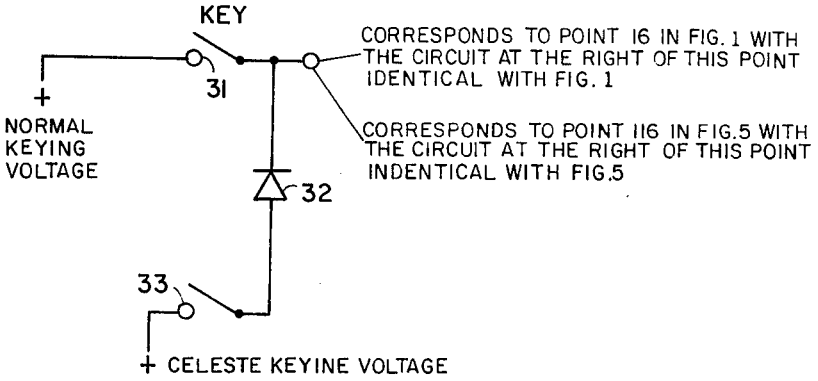
FIG. 2 is an alternate keying circuit diagram for use with the circuit shown in FIG. 1.

Another method of controlling the voltage at point 16 is shown in FIG. 2. When key switch 31 is closed, the + normal keying voltage is supplied directly to point 16. The + normal keying voltage is high so diode 32 is provided to block a flow of current if key switches 31 and 33 should be closed at the same time. When key switch 33 is closed with key switch 31 open, the lower + celests keying voltage is supplied to point 16 through diode 32.

Figure 3:
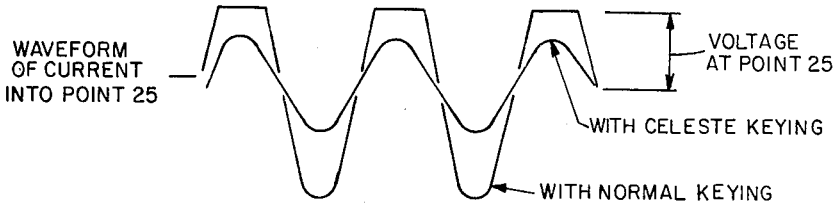
FIGS. 3 and 4 are wave form drawings.

Two differing waveforms are available from the subject oscillator when operated in this mode; the waveform output being dependent on the keying voltage appearing at point 16. When this voltage is high, as was explained previously, the voltage swing across inductor 7 is high. When it is high enough to cause a portion of its positive swing to exceed the voltage at point 25, which voltage is controlled by the emitter of preamplifier transistor 26 and determined by its base bias, diode 2 goes out of conduction clipping the positive swing at this point. The resulting output waveform is shown in FIG. 3.

When keying voltage is low, as is used for the celeste mode, the positive swing of the voltage across inductor 7 is not sufficient to exceed the voltage at point 25 and therefore diode 2 does not go out of conduction, but passes the entire signal. The resulting output waveform is also shown in FIG. 3.

Therefore, two differing waveforms can be obtained by changing the keying voltage.

Figure 4:
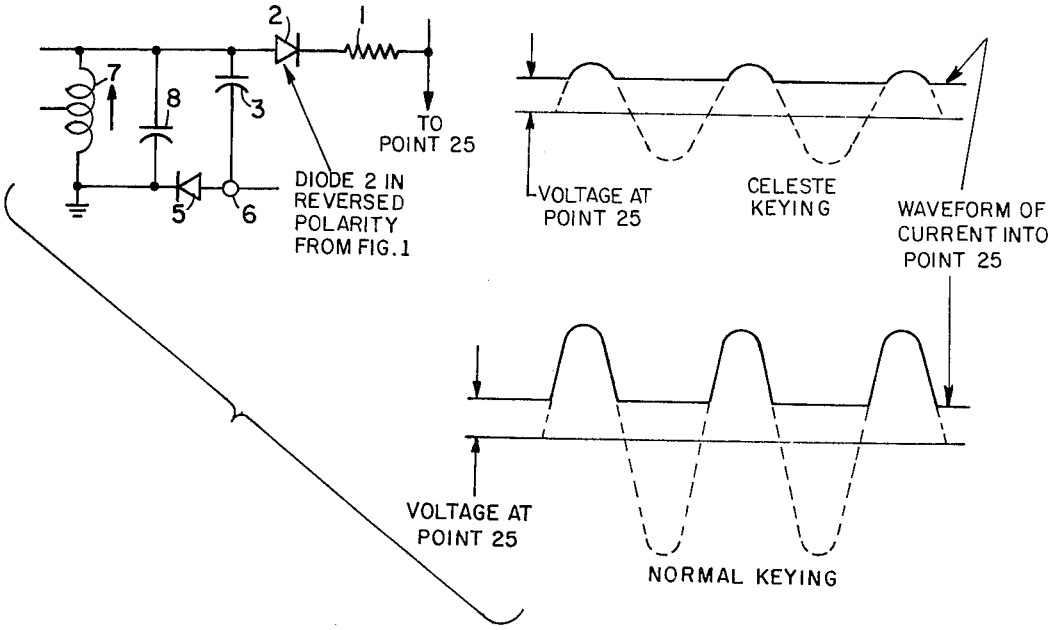

Diode 2 may be reversed in the circuit of FIG. 1, and if the voltage at point 25 is not changed, diode 2 would only conduct when the high keying voltage is used, the low keying voltage producing insufficient signal across inductor 7. Voltage at point 25 may be lowered so that diode 2 conducts over a small portion of the signal across inductor 7 when low keying voltage is used producing a sound having little fundamental and rich harmonies. When keyed with the high voltage, the higher signal voltage across inductor 7 causes diode 2 to conduct over a larger portion of this signal producing a signal having more fundamental, more overall amplitude, and slightly higher frequency. These configurations are shown in FIG. 4.

Figure 6:
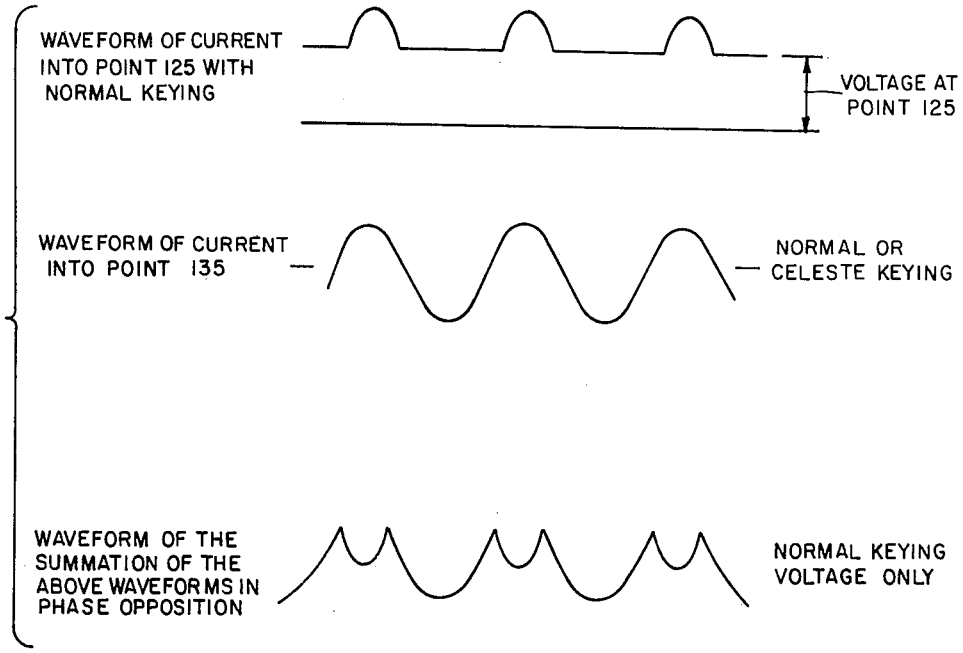
FIGS. 6 and 7 are wave forms for the circuits shown.

Another variation on this circuit is shown in FIG. 5 where the original voltage is used at point 125 and diode 102 is connected so that no signal passes through it when the oscillator is keyed with the low voltage, but resistor 131 has been added to pass the signal, which is essentially a sine wave signal, through to the emitter of transistor 133. When the high keying voltage is used, diode 102 conducts over a portion of the signal voltage across inductor 107 passing that signal on to the emitter of transistor 126. The outputs of these two transistor preamplifiers may be combined so as to add or so as to subtract producing a complex signal similar to that shown in FIG. 6.

The combining of these outputs to produce this complex signal is performed by a summing circuit 135 which is designated as a block in FIG. 5 because an "op-amp" having positive and negative inputs may be used, or one of several descrete circuit configurations may be used to accomplish the same end.

Referring to FIG. 5, an oscillator is shown consisting of transistor 112, tapped inductor 107, capacitor 108, and bias network for transistor 112 consisting of resistors 109 and 110. The base of transistor 112 is connected to one end of inductor 107 through resistor 110 and the emitter of transistor 112 is connected to the top of inductor 107 through resistor 111.

Keying voltage is applied to this oscillator through resistors 113 and 115 and capacitor 114 so that the attack and release may be controlled and may be adjusted to a pipe-like quality.

When the oscillator is keyed into operation by action of key switch 120, a sine wave appears across inductor 107 and capacitor 108. This sine wave supplies A. C. current to point 106 through capacitor 103. Point 106 is supplied with D. C. current through resistor 104 from the emitter of transistor 123. These two currents add in point 106 and as long as the sum is positive, diode 105 is in conduction, and point 106 is effectively connected to ground through diode 105. When the sum of these two currents is negative, diode 105 goes out of conduction and the voltage at point 106 goes below ground potential. The amplitude of this sine wave across inductor 107 is dependent on the amount of keying voltage actually reaching point 116 and several means are shown for controlling this voltage. The higher voltage across inductor 107 (normal keying voltage) causes diode 105 to go out of conduction for a larger portion of the cycle as compared with when the lower voltage appears across inductor 107 because this higher voltage causes increased current to flow through capacitor 103 into point 106, which in the negative portion of its cycle, cancels the D. C. current supplied by resistor 104 into this point for a larger portion of the cycle.

Capacitor 103, when connected across tuning capacitor 108 will cause the oscillator to operate at a lower frequency. When diode 105 is conducting capacitor 103 is connected across tuning capacitor 108. If diode 105 is in conduction 50% of the time, half value of capacitor 103 is added to capacitor 108. When the oscillator is operated with a high voltage at point 116, the signal voltage across inductor 107 is higher than when the oscillator is operated with a low voltage at point 116. This higher signal voltage causes diode 105 to be driven out of conduction for a larger percentage of time then when the lower signal voltage is present across inductor 107. Therefore, the frequency of operation will be higher with the higher keying voltage, and lower with the lower keying voltage.

In FIG. 5, vibrato voltage is applied to the base of transistor 123 and this causes the voltage at its emitter to be raised and lowered at the vibrato frequency. Point 106 is supplied with D. C. current through resistor 104 from the emitter of transistor 123, and this current is thus modulated at the vibrato frequency. This current adds with the A. C. current supplied to point 106 through capacitor 103 when the oscillator is in operation and causes diode 105 to be in conduction, or to go out of conduction as is described in the specification. Therefore, the percentage of time that diode 105 is in conduction is modulated at the vibrato rate and also the percentage of time capacitor 103 is connected across inductor 107 by diode 105 is so modulated. Since connecting capacitor 103 across inductor 107 lowers the frequency of oscillation, frequency modulation is achieved by independent means.

Figure 7:
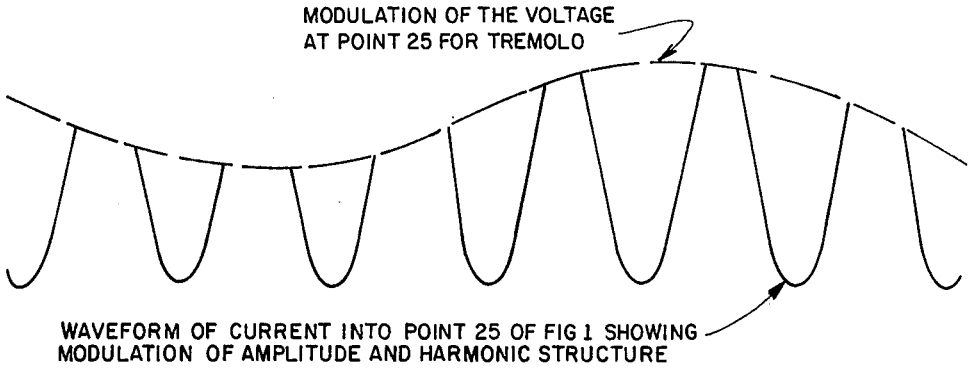

One method of controlling the voltage at point 116 is shown in FIG. 5. The + celeste clamp voltage is lower in magnitude than the + keying voltage and is obtained from rigid or a non-varying source. Then switch 130 is closed, and key switch 120 is closed, the voltage at the junction of diodes 117 and 118 and resistor 119 is limited by the + Celeste Clamp Voltage because current is caused to flow through resistor 119 and diodes 118 and 129 in series causing the voltage drop across resistor 119 to be increased to make up the difference between the + keying voltage and the + celeste clamp voltage. When switch 130 is open, no extra current is caused to flow through resistor 119 when key switch 120 is closed, causing full voltage to appear at point 116.

Where it is desired to have amplitude modulation and harmonic structure modulation of the normal signal output of the generator for the purpose of tremolo or tremulant enchancement, for example, the + Bias on the base of transistor 26 of FIG. 1 may be varied at the tremolo rate causing the cut-off point of diode 2 to vary. This causes the amplitude and harmonic structure modulation of the normal output signal of the generator to occur as is shown in FIG. 7. Note that this modulation need not occur on the celeste output of this generator. The generator shown in FIG. 5 may have this effect applied to it in exactly the same manner, namely, the + Bias on the base of transistor 126 may be varied at the tremolo rate causing the cut-off point of diode 102 to vary.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An electronic circuit for a musical instrument comprising:

a keying circuit for generating a keying voltage;

an oscillator made operative by application of said keying voltage thereto;

control means coupling said keying circuit to said oscillator whereby said keying voltage applied to said oscillator is controlled;

frequency modulation means coupled to said oscillator whereby the frequency of oscillation is modified in response to the magnitude of said keying voltage;

said keying circuit consists of a first keying means for generating a keying voltage of high magnitude for normal effects, and coupled directly to said oscillator; and a second keying means for generating a keying voltage of lower magnitude than said high magnitude for celeste effects, and coupled to said oscillator through an isolation diode to the exclusion of any other controlling means.

2. The invention as defined in claim 1 wherein the means coupled to said oscillator whereby the frequency of oscillation is modified in response to the magnitude of said keying voltage also modifies the frequency of oscillation by means independent of said keying voltage for purpose of frequency modulation effects.

3. The invention as defined in claim 2 whereby said means coupled to said oscillator whereby the frequency of oscillation is modified consists of a resistor, a diode and a capacitor.

4. The invention as defined in claim 1 whereby said oscillator includes an inductive and capacitance network for determining the selected frequency of said oscillator.

5. The invention as defined in claim 1 wherein means coupling said keying circuit to said oscillator whereby keying voltage applied to said oscillator is controlled consists of a resistor and at least one diode.

6. The invention as defined in claim 1 wherein the output waveform from said oscillator is controlled by the magnitude of said keying voltage applied to said oscillator.

7. The invention as defined in claim 6 wherein the output waveform from said oscillator is modified by a second means independent of the keying voltages and coupled to the output of said oscillator via a diode and a resistor connected in electrical series relationship for the purpose of amplitude and harmonic variation effects.

8. The invention as defined in claim 1 wherein said oscillator provides two output waveforms, one of which is present whenever said oscillator is keyed into operation by said keying voltage, and the other of which is present only when said oscillator is keyed into operation with the higher magnitudes of said keying voltage.

9. The invention as defined in claim 8 wherein these two output waveforms are electrically added in a summing circuit to provide a single waveform which undergoes a change in harmonic structure as a function of the magnitude of keying voltages applied to said oscillator.

* * * * *

UNITED STATES PATENT OFFICE

CERTIFICATE OF CORRECTION

Patent No. 4,044,643 Dated August 30, 1977

Inventor(s) Willis E. Chase

It is certified that error appears in the above-identified patent and that said Letters Patent are hereby corrected as shown below:

On the cover sheet item [76] "Lancaster, Pa. 93534" should read -- Lancaster, Calif. 93534 --.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*